US010208632B2

(12) United States Patent
Weidauer et al.

(10) Patent No.: US 10,208,632 B2
(45) Date of Patent: Feb. 19, 2019

(54) VARIABLE VALVE TIMING CAMSHAFT WITH IMPROVED OIL TRANSFER BETWEEN INNER AND OUTER SHAFTS

(71) Applicant: ThyssenKrupp Presta TecCenter AG, Eschen (LI)

(72) Inventors: Marcel Weidauer, Chemnitz (DE); Bernd Mann, Zschopau (DE); Uwe Dietel, Lichtentanne (DE); Juergen Meusel, Dittmannsdorf (DE); Michael Kunz, Chemnitz (DE); Martin Lehmann, Mittelndorf (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 0 days.

(21) Appl. No.: 15/314,444

(22) PCT Filed: Apr. 30, 2015

(86) PCT No.: PCT/EP2015/059581
§ 371 (c)(1),
(2) Date: Nov. 28, 2016

(87) PCT Pub. No.: WO2015/180925
PCT Pub. Date: Dec. 3, 2015

(65) Prior Publication Data

US 2017/0183981 A1 Jun. 29, 2017

(30) Foreign Application Priority Data

May 27, 2014 (DE) ..... 10 2014 107 475

(51) Int. Cl.
*F01L 1/34* (2006.01)
*F01L 1/047* (2006.01)
*F01L 1/344* (2006.01)

(52) U.S. Cl.
CPC ..... *F01L 1/047* (2013.01); *F01L 1/3442* (2013.01); *F01L 2001/0471* (2013.01); *F01L 2001/0473* (2013.01); *F01L 2001/0475* (2013.01)

(58) Field of Classification Search
CPC . F01L 1/047; F01L 1/3442; F01L 2001/0471; F01L 2001/0475
See application file for complete search history.

(56) References Cited

U.S. PATENT DOCUMENTS 4,974,561 A 12/1990 Murasaki et al.
5,823,152 A 10/1998 Ushida

FOREIGN PATENT DOCUMENTS

CN 202215574 U 5/2012
DE 3602477 A1 7/1986
(Continued)

OTHER PUBLICATIONS

Int'l Search Report for PCT/EP2015/059581 dated Nov. 18, 2015 (dated Nov. 26, 2015).
(Continued)

*Primary Examiner* — Zelalem Eshete
(74) *Attorney, Agent, or Firm* — thyssenkrupp North America, Inc.

(57) ABSTRACT

An adjustable camshaft may include an outer shaft that is hollow and an inner shaft received in the outer shaft and rotatable in the outer shaft. The inner shaft may include a cavity into which oil can be applied. At least a first radial opening may be configured in the outer shaft and at least a second radial opening may be configured in the inner shaft. Thus oil can flow between the cavity and an outside of the outer shaft during overlap of the first radial opening and the second radial opening. The first radial opening on an inside
(Continued)

of the outer shaft may have a greater cross-section than on the outside of the outer shaft.

16 Claims, 3 Drawing Sheets

(56) References Cited

FOREIGN PATENT DOCUMENTS

| | | | |
|---|---|---|---|
| DE | 102005014680 | A1 | 8/2006 |
| DE | 102006028611 | A1 | 12/2007 |
| DE | 102011077532 | A1 | 12/2012 |
| DE | 102011082591 | A1 | 3/2013 |
| EP | 2415979 | A1 | 2/2012 |
| EP | 2527607 | A2 | 11/2012 |
| JP | H10122228 | A | 5/1998 |

OTHER PUBLICATIONS

English Language Abstract for DE3602477A1.
English Language Abstract for DE102005014680A1.
English Language Abstract for EP2527607A2.
Written Opinion of the International Search Authority (no English translation available).

VARIABLE VALVE TIMING CAMSHAFT WITH IMPROVED OIL TRANSFER BETWEEN INNER AND OUTER SHAFTS

CROSS REFERENCE TO RELATED APPLICATIONS

This application is a U.S. National Stage Entry of International Patent Application Serial Number PCT/EP2015/059581, filed Apr. 30, 2015, which claims priority to German Patent Application No. DE 10 2014 107 475.0 filed May 27, 2014, the entire contents of both of which are incorporated herein by reference.

FIELD

The present disclosure relates to camshafts and, more particularly, to camshafts that more effectively transfer oil between inner and outer shafts.

BACKGROUND

DE 36 02 477 A1 shows, as an example, a camshaft having a cavity that extends centrally through the camshaft, and the camshaft has a radial bore, so that oil can be transported between the cavity and the outside of the camshaft. In this regard, the oil transport to the outside of the camshaft serves for lubrication of slide bearings, by way of which the camshaft is accommodated in a cylinder head so as to rotate.

From DE 10 2005 014 680 A1, an adjustable camshaft having a phase shifter is known, and at least two oil connections are known for activation of the phase shifter, by way of which connections pressure oil can be applied to the phase shifter for activation. In order to apply oil to the phase shifter, a pressure connection must be transferred from a resting component to the rotating camshaft, because the phase shifter rotates along with the camshaft. The first main bearing of the adjustable camshaft, which borders on the phase shifter, is frequently used to apply pressure with oil, and pressure oil is transferred to the rotating camshaft by way of an inner bearing shell, which rotates along with the outer shaft of the camshaft by way of circumferential grooves. In this regard, radial bores are provided between circumferential grooves in the bearing shell, into which radial bores open, which extend through the bearing shell, the outer shaft, and the inner shaft, and the radial bore in the inner shaft opens into the cavity in the inner shaft.

A further example of an adjustable camshaft with oil transfer from a resting bearing shell to a phase shifter that rotates with the camshaft is known from EP 2 527 607 A2. The inner shaft and the outer shaft have radial openings, wherein the openings in the outer shaft must have an elongated expanse facing in the circumferential direction, in order to allow coverage of the radial opening in the inner shaft with the radial opening in the outer shaft by way of an adjustment angle of the inner shaft in the outer shaft. However, it is disadvantageous that as a result, the outer shaft is significantly weakened.

If the inner shaft and/or the outer shaft has/have a circumferential groove, so that the fluid connection between the radial opening in the inner shaft and the radial opening in the outer shaft takes place by way of the circumferential groove, it is true that coverage of the radial openings is not required, but the mechanical ability of the outer shaft and/or that of the inner shaft to withstand stress is weakened by the circumferential groove. In particular, the weakening adds up when the grooves are provided along with elongated openings that extend in the circumference direction, so that the strength of the camshaft can reach critical lower limits.

To guarantee oil flow even in boundary positions of the angle adjustment of the inner shaft in the outer shaft, it is necessary to create an elongated expanse, in the circumferential direction, of the opening in the outer shaft, so that even in the end angle positions of the rotated inner shaft in the outer shaft, essentially complete coverage of the radial openings in the inner shaft and the outer shaft is guaranteed. Depending on a required rotation range of the inner shaft in the outer shaft, over an angle of rotation, the first radial openings must be structured to be very long in the circumference direction of the outer shaft, thereby resulting in significant weakening of the camshaft.

DETAILED DESCRIPTION

Figure 1:
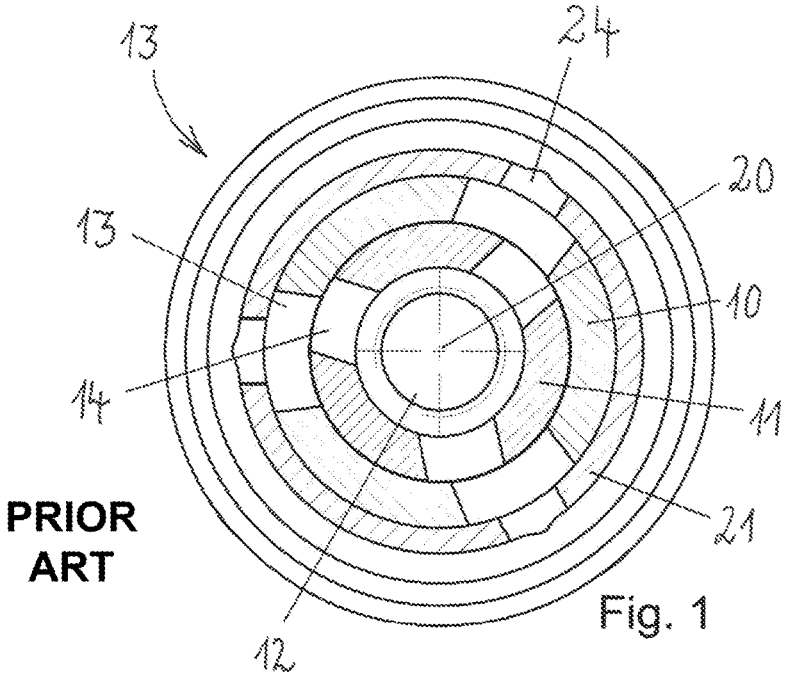
FIG. 1 is a cross-sectional view of a prior art adjustable camshaft.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims.

The present disclosure generally concerns adjustable camshafts that may have a constructed outer shaft and an inner shaft received in the outer shaft so as to rotate. The inner shaft may have a cavity to which oil can be applied. At least a first radial opening may be configured in the outer shaft, and at least a second radial opening may be configured in the inner shaft. Oil is thereby allowed to flow between the cavity and an outside of the outer shaft when the first radial opening is covered by the second radial opening.

One example object of the present disclosure is to further develop an adjustable camshaft without significant mechanical weakening caused by oil transfer locations, wherein oil transfer between a cavity in the inner shaft and the outer shaft is supposed to be guaranteed even at great rotation ranges of the inner shaft in the outer shaft.

Further, in some examples, the first radial opening on the inside of the outer shaft may have a greater cross-section than on the outside of the outer shaft and/or the second radial opening on the outside of the inner shaft may have a greater cross-section than on the inside of the inner shaft.

By means of the configuration of the first radial opening in the outer shaft or of the second radial opening in the inner shaft, it is made possible that full coverage, or overlap, of the first and second radial openings can occur even in the angle end positions of rotation of the inner shaft in the outer shaft, without the first radial opening in the outer shaft extending over a circumference range that corresponds to the complete angle range of the adjustment of the inner shaft in the outer shaft. In this way, the further advantage is achieved, at an optimized oil flow between the cavity and the outside of the camshaft, that the camshaft is only minimally weakened in terms of its ability to withstand stress.

The first radial opening can have a section that opens toward the inside, edged by bevels, and a cylindrical section that opens to disemboque in the outside. In this way, the first radial opening can be structured to be trapezoid in cross-section and, in particular, a smaller opening width toward the outside of the opening allows maintaining the ability of the outer shaft to withstand stress, since the moment of surface inertia is less reduced by the lesser material removal radially on the outside. In the same manner, the second radial opening in the inner shaft can have a conically widened region, for example, in a section in the direction of the outside of the inner shaft.

According to an advantageous embodiment, the first radial opening can have a cross-section that opens into disemboque in the inside, which is determined in such a manner that essentially complete coverage of the cross-section with the second radial opening in the inner shaft is made possible by way of the range of rotation of the inner shaft in the outer shaft. For example, the bevels that edge the section of the opening in the direction toward the inside in the outer shaft can be defined in such a manner that even in the angle end position of the rotated inner shaft in the outer shaft, full coverage of the second radial opening in the inner shaft by the inside opening region of the first radial opening occurs. Furthermore, the first radial opening can have an elongated expanse in the circumference direction, wherein the bevels can be provided in the end regions of the elongated, radial opening. Furthermore, however, the bevels can additionally be provided also in the side regions, so that the trapezoid shape occurs over the entire edge of the first radial opening.

In this regard, the embodiment of the second radial opening in the inner shaft can be configured in addition to the embodiment, according to the invention, of the first radial opening in the outer shaft, so that it is also provided that the second radial opening on the outside of the inner shaft has a greater cross-section than on the inside of the inner shaft. As a result, the angle range for complete coverage of the openings is further increased.

An oil feed location for controlling a phase shifter can be formed by the radial openings in the outer shaft and in the inner shaft, wherein two and preferably three openings can be provided in the outer shaft and in the inner shaft, evenly distributed over the circumference. In this regard, according to a further embodiment, the openings in the outer shaft can also be present in quadruplicate, and can be unevenly distributed over the circumference, wherein at the same time, four openings can be provided in the inner shaft, which have the same angle division distributed over the circumference.

By means of the connection between the cavity in the inner shaft and the outside of the outer shaft formed by means of the corresponding radial openings, the inside of the outer shaft and/or the outside of the inner shaft can be configured without grooves, at least in the region of the radial openings. If the outer shaft and/or the inner shaft does not have a circumferential groove, with which oil transport between the radial openings in the inner shaft and the outer shaft would normally be made possible even in the case of rotation without coverage, the outer shaft and/or the inner shaft consequently also does not experience any mechanical weakening.

The ratio of the opening width in the mouth toward the outside, to the opening width in the mouth toward the inside of the first radial opening can amount to 0.6 to 0.9, for example, and preferably 0.7 to 0.8, wherein this value can also be provided for the embodiment of the inner shaft according to the invention. The smaller the opening width of the mouth to the outside of the first radial opening, the smaller the cross-section with which the first radial opening opens into the outside of the outer shaft, and the less the weakening of the ability of the camshaft to withstand stress.

The geometrical embodiment of the at least one first radial opening in the outer shaft, according to the invention, can be produced using a shaft milling cutter, for example, in that the shaft milling cutter is set on at an angle in the opening. Likewise, the use of a contour milling tool is possible.

Leading further, it can be provided that the inner shaft has radial openings that are evenly distributed over the circumference and enclose the same angle relative to one another, in each instance, and that the outer shaft has radial openings that are configured to be unevenly distributed over the circumference, particularly in pairs.

Alternatively, it can be provided that the outer shaft has radial openings that are evenly distributed over the circumference and always enclose the same angle relative to one another, in each instance, and that the inner shaft has radial openings that are configured to be unevenly distributed over the circumference, particularly in pairs.

In the case of uneven distribution of the radial openings on the inner shaft and/or on the outer shaft, the result can be achieved that the division of the radial openings on the outer shaft or on the inner shaft is configured in such a manner that coverage of all the openings of the inner shaft and of the outer shaft exists only in an adjustment range center of the rotation of the inner shaft in the outer shaft. In this regard, the coverage can exist as the result of the larger mouth cross-section of the radial openings and the selection of the angle between the radial openings, in such a manner that the flow cross-section of all the openings, added up over the range of rotation of the inner shaft in the outer shaft, remains essentially unchanged, and the influence of the angle position on the adjustment speed and on the regulation behavior of a phase shifter, which is supplied with pressure means by the radial bore, is minimized.

FIG. 1 shows a cross-section through an adjustable camshaft 1 according to the state of the art, and the camshaft 1 has an outer shaft 10 and an inner shaft 11, and the inner shaft 11 extends through the outer shaft 10, configured to be hollow. The two shafts 10 and 11 can jointly rotate about an axis of rotation 20.

The inner shaft 11 has a cavity 12 that extends partly through it, to which cavity pressure oil can be applied, for example. On the outside, a bearing ring 21 extends around the outer shaft 10, and the bearing ring 21 has openings 24. If pressure oil is applied to the outside of the bearing ring 21, by way of a further bearing ring, not shown, the oil gets into the openings 24, which agree, in terms of their position, with the first radial openings 13 in the outer shaft 10. In order to allow oil flow between the bearing ring 21 and the cavity 12, second radial openings 14 are provided in the inner shaft 11, and the first radial openings 13 must be configured to extend over a circumference angle, elongated in the circumference direction, in such a manner that even in the angle end positions during rotation of the inner shaft 11 in the outer shaft 10, sufficient coverage of the first and second radial openings 13 and 14 is guaranteed. The figure shows a rotated inner shaft 11, so that coverage of the openings 13 and 14 only takes place partially. As a result, the oil flow between the cavity 12 and the bearing ring 21 is reduced.

Figure 2A:
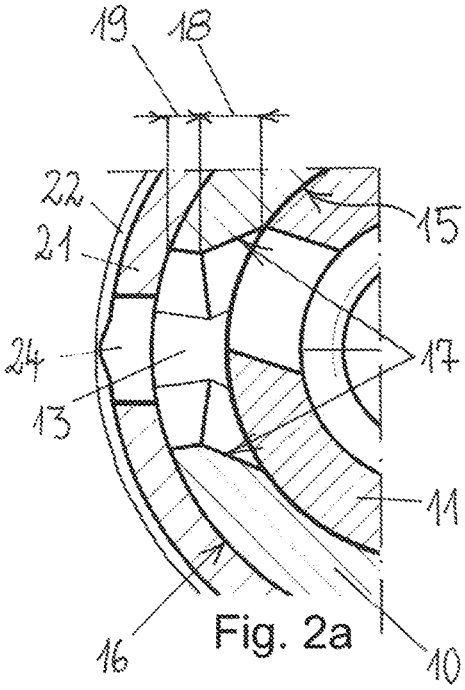
FIG. 2*a* is an enlarged detail view of a first radial opening in an outer shaft of the example adjustable camshaft of FIG. 2.
Figure 2:
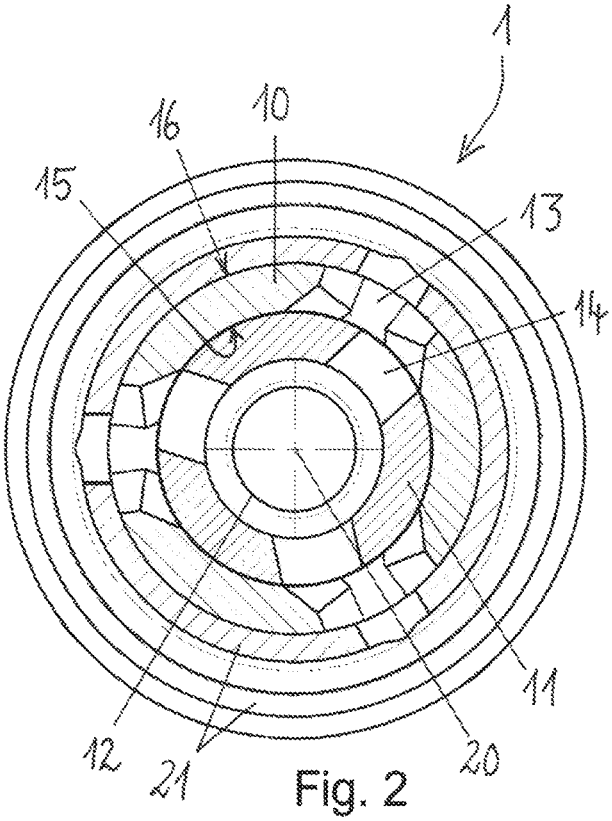
FIG. 2 is a cross-sectional view of an example adjustable camshaft.

FIG. 2 shows the adjustable camshaft, developed further according to the invention, having first openings 13 introduced into the outer shaft 10, which have a greater cross-section on the inside 15 of the outer shaft 10 than on the outside 16 of the outer shaft 10. The inner shaft 11, shown rotated, has two radial openings 14, which demonstrate full coverage with the first radial openings 13 that open to the inside 15, in spite of the rotation. As a result, weakening of the oil flow between the cavity 12 and the bearing ring 21 is avoided; furthermore, the first radial openings 13 on the outside 16 of the outer shaft 10 have a smaller cross-sectional dimension, thereby minimizing mechanical weakening of the outer shaft 10.

FIG. 2*a* shows the geometrical configuration of a first radial opening 13 in a trapezoid shape, and a section 18 has bevels 17 that open into a cylindrical section 19. This results in a trapezoid cross-sectional shape of the first radial openings 13.

The enlarged representation furthermore shows a circumferential ring gap 22 in the bearing ring 21, by way of which oil supply to the opening 24, for transfer of the oil to the first radial opening 13 in the outer shaft 10, remains guaranteed during rotation of the bearing ring 21 in a further bearing ring.

Figure 3:
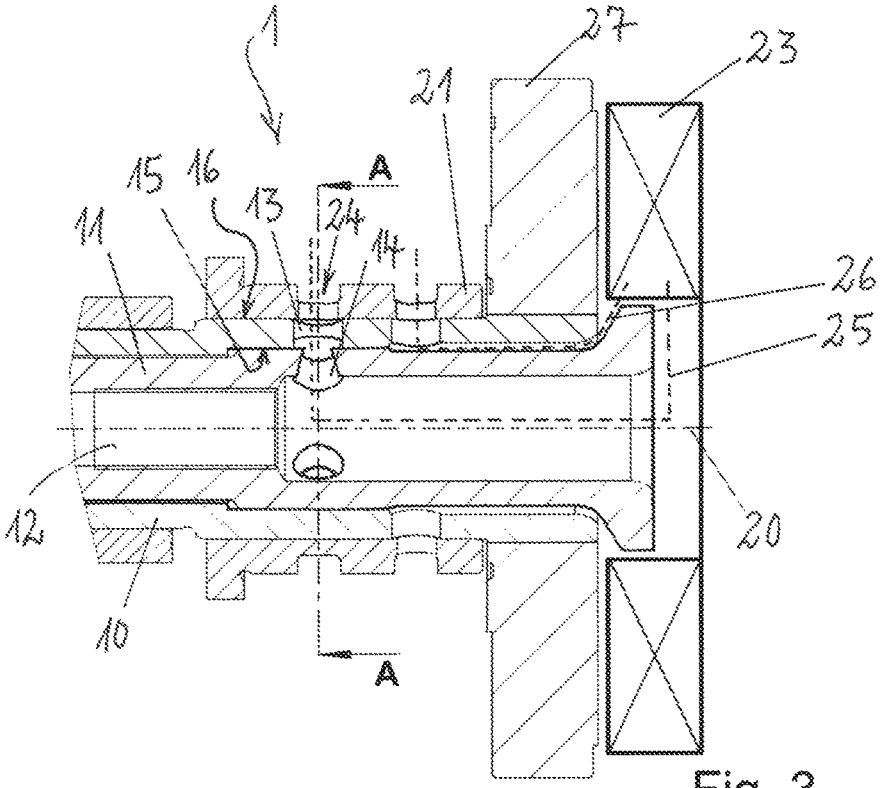
FIG. 3 is a cross-sectional view of an example adjustable camshaft with oil channels that are coupled with an example phase shifter, which is shown schematically.

FIG. 3 shows a cross-sectional view through the camshaft 1, for a further explanation of the embodiment of the adjustable camshaft 1 having the openings 13 according to the invention, and on the end side, on the camshaft 1, a phase shifter 23 is shown adjacent to a drive wheel 27, which is coupled with the outer shaft 10. In this regard, the drive wheel can also be part of the housing of the phase shifters 23.

In order to rotate the inner shaft 11 back and forth in the outer shaft 10, the phase shifter 23 must alternately be supplied with oil by way of two oil channels, and a first oil channel 25 comprises the cavity 12, the second radial opening 14, the first radial opening 13, as well as the opening 24 in the bearing ring 21. The first oil channel 25 is supplied, for example, by pressure application by way of a resting, outside bearing ring (not shown), in which the bearing ring 21 is accommodated and forms a slide bearing with it.

A second oil channel 26 is formed by way of further openings in the bearing ring 21 and in the outer shaft, wherein the second oil channel 26 does not, however, pass through the inner shaft 11.

When the camshaft 1 rotates about the axis of rotation 20, pressure application of the first oil channel 25 takes place for corresponding activation of the phase shifter 23, by way of the bearing ring 21 and the opening 24. In this regard, an embodiment of the first radial opening 13 according to the invention is shown, which opens on the inside in the direction toward the second radial opening 14. In this regard, the first radial opening 13 has a greater cross-section in the mouth on the inside 15 than in the mouth to the outside 16 of the outer shaft 10.

Figure 4:
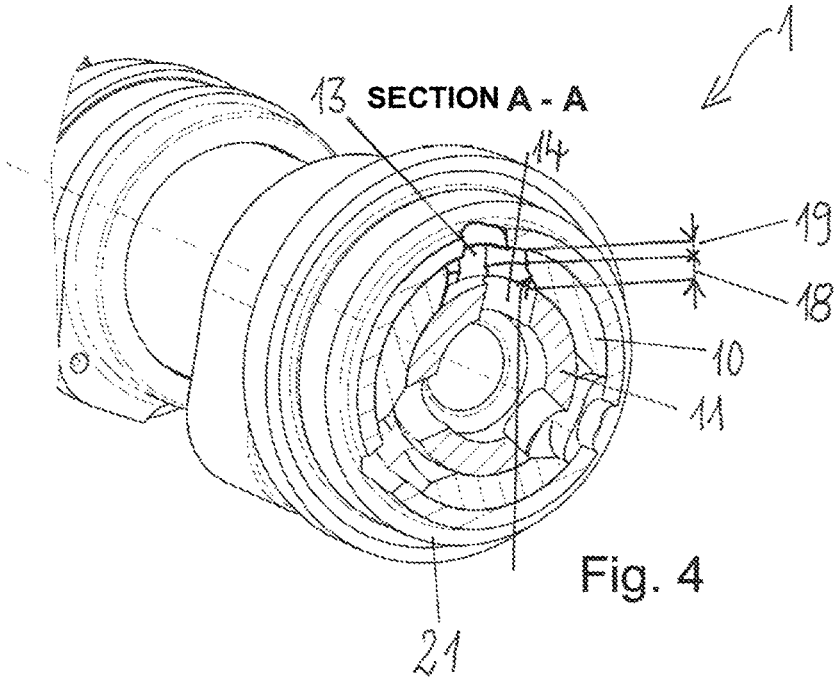
FIG. 4 is a cross-sectional view of the example adjustable camshaft of FIG. 3 taken along line A-A.

FIG. 4, finally, shows a view along the section line A-A according to FIG. 3. In the cross-sectional view, the bearing ring 21 as well as the outer shaft 10 and the inner shaft 11 are shown in cross-section, wherein the section runs through the openings 13 and 14. In this regard, the sectional view shows three first radial openings 13 in the outer shaft 10 and three second radial openings 14 in the inner shaft 11, evenly distributed over the circumference. In detail, the geometrical configuration of the first radial openings 13 having the characteristics of the invention is shown, and the first radial openings 13 possess a greater cross-section on the inside of the outer shaft 10 than on the outside of the outer shaft 10. The side regions of the first radial openings 13 are edged by a cylindrical section 19 in the direction toward the outside, and by a section 18 toward the inside, which is laterally delimited by bevels 17.

Figure 5A:
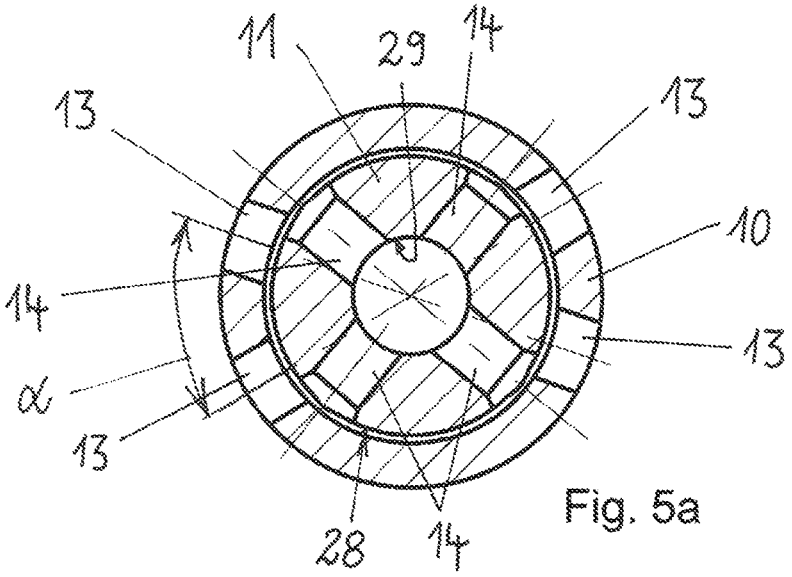
FIG. 5*a* is a cross-sectional view of another example adjustable camshaft wherein an inner shaft is shown in a rotational position in which a first radial opening demonstrates partial coverage with a second radial opening.
Figure 5B:
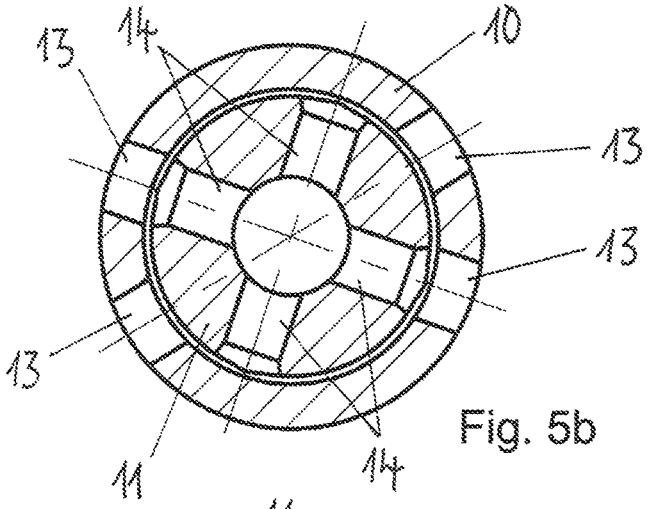
FIG. 5*b* is a cross-sectional view of the adjustable camshaft of FIG. 5*a* wherein the inner shaft is shown in a rotational position in which the first radial opening demonstrates full coverage with the second radial opening.
Figure 5C:
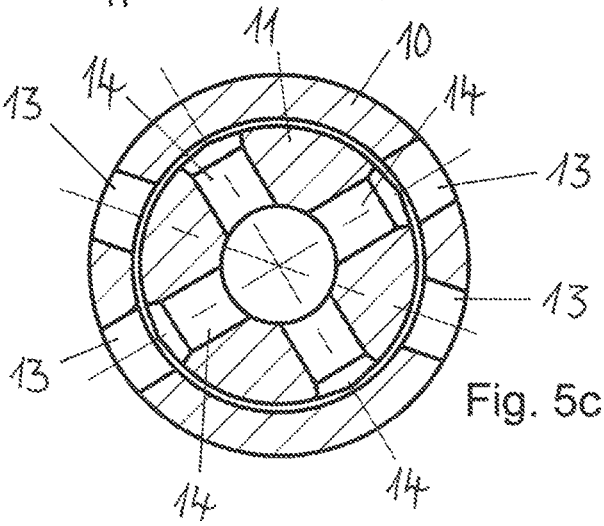
FIG. 5*c* is a cross-sectional view of the adjustable camshaft of FIG. 5*a* or 5*b* wherein the inner shaft is shown in a rotational position in which two radial openings of an outer shaft overlap with two radial openings of an inner shaft, and wherein two other radial openings of the outer shaft do not overlap with two other radial openings of the inner shaft.

FIGS. 5*a*, 5*b* and 5*c* show, in different rotational positions of the inner shaft 11 in the outer shaft 10, a cross-section through a further exemplary embodiment of an adjustable camshaft 1. The inner shaft 11 has four radial openings 14, as an example, and the radial openings 14 are evenly distributed over the circumference and enclose an angle of 90° relative to one another, in each instance. The outer shaft 10 also has four openings 13, of which two pairs of openings 13, standing diametrically opposite one another at 180°, enclose an angle $\alpha$ of less than 90°. As a result, the inner shaft 11 can be rotated in such a manner that only two of the four openings 14 of the inner shaft 11, for example, stand in coverage with openings 13 of the outer shaft 10.

In FIG. 5*a*, a rotational position of the inner shaft 11 in the outer shaft 10 is shown, in which all four openings 14 of the inner shaft 11 demonstrate partial coverage with openings 13 in the outer shaft 10. The partial coverage is promoted by the embodiment according to the invention, that the second radial opening 14 on the outside 28 of the inner shaft 11 has a greater cross-section than on the inside 29 of the inner shaft 11. For example, the openings 13 in the outer shaft 10 are configured in pairs relative to one another, and the angle $\alpha$ between two adjacent openings 13 is selected in such a manner that in an adjustment range center, all the openings 14 of the inner shaft 11 are partly covered.

FIG. 5*b* shows a first end position of rotation, in which two of four openings 14 in the inner shaft 11 are in coverage with openings 13 in the outer shaft 10.

FIG. 5*c* shows a second end position of rotation, in which two other ones of the four openings 14 in the inner shaft 11 are brought into coverage with openings 13 in the outer shaft 10.

FIGS. 5*a*, 5*b* and 5*c* show, in this regard, an exemplary embodiment of the invention, in which the second radial openings 14 on the outside 28 of the inner shaft 11 have a greater cross-section than on the inside 29 of the inner shaft 11. In this way, the same effect can be achieved, that even in the end positions of rotation of the inner shaft 11 in the outer shaft 10, full coverage of the two passages 13, 14 is already achieved.

By means of the exemplary embodiment of FIGS. 5*a*, 5*b*, and 5*c*, adaptation of the inner pipe geometry is not absolutely necessary, and no milling with an end mill on the inside 15 of the outer shaft 10 is required. The cutting machining of the outside 28 of the inner shaft 11, as shown, is possible in significantly simpler manner, in this regard.

The invention is not restricted, in its embodiment, to the preferred exemplary embodiment indicated above. Instead, a number of variants is conceivable, which make use of the solution presented even in fundamentally different types of embodiments. All of the characteristics and/or advantages that are evident from the claims, the specification or the drawings, including design details and spatial arrangements, can be essential to the invention both in themselves and in the most varied combinations.

REFERENCE SYMBOL LIST

1 adjustable camshaft
10 outer shaft
11 inner shaft
12 cavity
13 first radial opening
14 second radial opening
15 inside
16 outside
17 bevel
18 section
19 cylindrical section
20 axis of rotation
21 bearing ring
22 circumferential ring gap
23 phase shifter
24 opening
25 first oil channel
26 second oil channel
27 drive wheel
28 outside
29 inside
α angle

What is claimed is:

1. An adjustable camshaft comprising:
an outer shaft that is hollow and includes a first radial opening; and
an inner shaft disposed in the outer shaft and rotatable with respect to the outer shaft, the inner shaft including a cavity that receives oil and a second radial opening, wherein oil flows between the cavity of the inner shaft and an outside of the outer shaft during overlap of the first and second radial openings,
wherein a cross-section of the first radial opening is greater on an inside of the outer shaft than on the outside of the outer shaft.

2. The adjustable camshaft of claim 1 wherein the first radial opening of the outer shaft comprises
a section that opens to the inside of the outer shaft and is edged by bevels, and
a cylindrical section that opens to the outside of the outer shaft.

3. The adjustable camshaft of claim 2 wherein the first radial opening has an elongated expanse extending in a circumferential direction, wherein the bevels are disposed in end regions of the elongated expanse of the first radial opening.

4. The adjustable camshaft of claim 1 wherein the cross-section of the first radial opening opens to the inside of the outer shaft, wherein rotation of the inner shaft within the outer shaft permits substantially complete overlap between the cross-section of the first radial opening and the second radial opening in the inner shaft.

5. The adjustable camshaft of claim 1 wherein the first and second radial openings form an oil feed location for controlling a phase shifter, wherein the first radial opening is one of a plurality of radial openings that are distributed evenly about a circumference of the outer shaft, wherein the second radial opening is one of a plurality of radial openings that are distributed evenly about a circumference of the inner shaft.

6. The adjustable camshaft of claim 1 wherein at least one of
a region on the inside of the outer shaft around the first radial opening is free of grooves, or
a region on the outside of the inner shaft around the second radial opening is free of grooves.

7. The adjustable camshaft of claim 1 wherein a ratio of an opening width in a mouth to the outside of the first radial opening to an opening width in the mouth to the inside of the first radial opening is 0.6 to 0.9.

8. The adjustable camshaft of claim 1 wherein a ratio of an opening width in a mouth to the outside of the first radial opening to an opening width in the mouth to the inside of the first radial opening is 0.7 to 0.8.

9. An adjustable camshaft comprising:
an outer shaft that is hollow and includes a first radial opening; and
an inner shaft disposed in the outer shaft and rotatable with respect to the outer shaft, the inner shaft including a cavity that receives oil and a second radial opening, wherein oil flows between the cavity of the inner shaft and an outside of the outer shaft during overlap of the first and second radial openings,
wherein at least one of
a cross-section of the first radial opening is greater on an inside of the outer shaft than on the outside of the outer shaft, or
a cross-section of the second radial opening is greater on an outside of the inner shaft than on an inside of the inner shaft,
wherein the second radial opening is one of a plurality of radial openings that are evenly distributed about a circumference of the inner shaft and enclose a same angle relative to one another,
wherein the first radial opening is one of a plurality of radial openings that are distributed unevenly about a circumference of the outer shaft.

10. The adjustable camshaft of claim 9 wherein the plurality of radial openings distributed unevenly about the circumference of the outer shaft are distributed in pairs.

11. The adjustable camshaft of claim 9 wherein a division of the plurality of radial openings on the outer shaft are configured such that partial overlap of all of the plurality of radial openings on the outer shaft exists in a rotation range center of a rotation range.

12. The adjustable camshaft of claim 9 wherein a division of the plurality of radial openings on the inner shaft are configured such that partial overlap of all of the plurality of radial openings on the inner shaft exists in a rotation range center of a rotation range.

13. An adjustable camshaft comprising:
an outer shaft that is hollow and includes a first radial opening; and an inner shaft disposed in the outer shaft and rotatable with respect to the outer shaft, the inner shaft including a cavity that receives oil and a second radial opening, wherein oil flows between the cavity of the inner shaft and an outside of the outer shaft during overlap of the first and second radial openings, wherein at least one of a cross-section of the first radial opening is greater on an inside of the outer shaft than on the outside of the outer shaft, or a cross-section of the second radial opening is greater on an outside of the inner shaft than on an inside of the inner shaft, wherein the first radial opening is one of a plurality of radial openings that are evenly distributed about a circumference of the outer shaft and enclose a same angle relative to one another, wherein the second radial opening is one of a plurality of radial openings that are distributed unevenly about a circumference of the inner shaft.

14. The adjustable camshaft of claim 13 wherein the plurality of radial openings distributed unevenly about the circumference of the inner shaft are distributed in pairs.

15. The adjustable camshaft of claim 13 wherein a division of the plurality of radial openings on the outer shaft are configured such that partial overlap of all of the plurality of radial openings on the outer shaft exists in a rotation range center of a rotation range.

16. The adjustable camshaft of claim 13 wherein a division of the plurality of radial openings on the inner shaft are configured such that partial overlap of all of the plurality of radial openings on the inner shaft exists in a rotation range center of a rotation range.

* * * * *